US005394163A

United States Patent [19]

Bullen et al.

[11] Patent Number: 5,394,163

[45] Date of Patent: Feb. 28, 1995

[54] ANNULAR SLOT PATCH EXCITED ARRAY

[75] Inventors: William E. Bullen, Chino; Henry T. Killackey, Covina; Dean W. Collins, Claremont, all of Calif.

[73] Assignee: Hughes Missile Systems Company, Los Angeles, Calif.

[21] Appl. No.: 935,323

[22] Filed: Aug. 26, 1992

[51] Int. Cl.[6] ..... H01Q 13/10

[52] U.S. Cl. ..... 343/771; 343/700 MS; 343/700 R

[58] Field of Search ..... 343/700 MS, 767, 770, 343/771, 725, 846, 853; 29/600; H01Q 13/10

[56] References Cited

U.S. PATENT DOCUMENTS

| | | | |
|---|---|---|---|
| 4,864,314 | 9/1989 | Bond | 343/771 |
| 5,001,493 | 3/1991 | Patin et al. | 343/700 MS |
| 5,153,600 | 10/1992 | Metzler et al. | 343/700 MS |
| 5,239,311 | 8/1993 | Arimura et al. | 343/771 |

*Primary Examiner*—Donald Hajec
*Assistant Examiner*—Tan Ho
*Attorney, Agent, or Firm*—Charles D. Brown; Randall M. Heald; Wanda K. Denson-Low

[57] ABSTRACT

The target seeker system includes two radio frequency antennas consisting of two sets of radio frequency selective annular slot patch excited radiator receiver elements, one set for K-band energy, the other for X-band energy, sharing a common ground plane. The radio frequency antennas have a single multi-band image plate consisting of resonant dichroic surfaces which will selectively reflect X- and K-band energy. An image plate is formed with conductive patterns on each side of a low dielectric material. The reflective pattern acts as a quarter wavelength thick plate at the operating frequency. The top of the image plate which has X-band reflectors is spaced at one-half of the desired X-band wavelength above the ground plane and the K-band reflector on the bottom of the image plate is spaced at one-half of the desired K-band wavelength. The thickness of the image plate is adjusted to provide the appropriate relative spacing between the X-band reflecting surface on the top and the K-band reflecting surface on the bottom.

7 Claims, 3 Drawing Sheets

ANNULAR SLOT PATCH EXCITED ARRAY

BACKGROUND OF THE INVENTION

I. Field of the Invention

The present invention relates to radar seeker antennas and more specifically to multiple frequency radar seeker antennas.

II. Background Art

Dual mode target seeking systems for airborne vehicles are well known in the art for operating under combinations of electro-optical, usually infrared, and radio frequency signals. Such dual mode systems involve separate systems for each frequency range incorporated to fit into a limited volume. A variety of configurations are available including parabolic reflectors, as in U.S. Pat. No. 2,972,743 of Svensson, et al. and U.S. Pat. No. 3,114,149 of Jessen, flat plate reflectors, as in U.S. Pat. No. 3,701,158 of Johnson, and image plate arrays as in U.S. Pat. No. 4,698,638 of Branigan, et al. These systems are designed to permit detection of radio frequency (RF) and infrared (IR) signals simultaneously with varying degrees of success. None of the above patents suggest, however, a means for simultaneously detecting two or more different bands of RF radiation while including an electro-optical system.

Present seeker antenna systems do not provide ready interface with both X-band fire control radar systems presently deployed and K-band systems in development. Additionally, performance requirements for small aperture dual mode (IR/RF) missiles are not met by current antenna design. Due to the small aperture size for such antennas, and the dual mode criteria, neither conventional flat plate arrays nor parabolic reflectors meet the necessary gain and sidelobe requirements. Aperture blockage due to the IR mode of operation in both types of antennas, coupled with the additional feed structure for parabolic reflectors, results in lowered gain as well as high sidelobes and, as a result, susceptibility to enemy standoff jamming techniques.

The most efficient IR/RF seeker antenna system for achieving high gain and low sidelobe requirements where volumetric constraints are prevalent is the image plate antenna. In an image plate antenna, a partially RF reflecting sheet of material is placed parallel to the reflective ground plane containing the radiating element or the element array. The image plate is constructed of a dielectric material which is one-quarter wavelength thick and is fixed by a spacer to be one-half wavelength above the ground plane. A wave entering the antenna normal to the ground plane will be reflected and then re-reflected off of the partially reflective image plate, causing the wave to travel in increments of full wavelengths so that it reaches the receiving element in phase. In dual mode (IR/RF) systems, a window which is IR transmissive and RF reflective is placed in the center of the ground plane, with the IR detector behind the RF antenna. The thickness of the image plate and its fixed spacing above the ground plane permits only a portion of one RF band to be detected by the system.

A unique small aperture antenna configuration is required which provides adequate monopulse tracking capability for both X- and K-bands in concert with an integrated (centrally located) IR sensor. One approach (General Dynamics docket no. P-1215) to attain dual band operation, given a small aperture, is an array comprised of integrated frequency selective dipoles sharing a common ground plane, in conjunction with image plate technology. This approach, utilizing the theory of images, or reflection, consists of a pure reflector surface, a dual dichroic grid image plate, two 8-element dipole arrays, and two stripline corporate feed/comparator networks. A problem encountered with this approach is to attain optimum operation, the dipoles should be positioned midway between the pure reflector and the corresponding surface of the image plate. However, this geometry creates a high standing wave field distribution in the cavity between the two reflectors with maximum field amplitude at the dipole terminals. This effect substantially increases the input impedance of the image plate-type dipole to a value approximately four times greater than that of a conventional dipole. This, in turn, causes difficulty in realizing acceptable bandwidth performance. Another issue is the dual band array's protruding radiating dipoles. The condition imposes severe aperture constriction that creates parameter degradation.

It would be desirable to have a system capable of operating at two or more different radio frequencies with high efficiency and minimum degradation while still permitting the weight- and size-economical inclusion of an electro-optical system. It is to this objective that the present invention is directed.

SUMMARY OF THE INVENTION

It is an advantage of the present invention to provide a target-seeking antenna system which is capable of high efficiency operation within two or more separate bands of RF while still providing a means of including an efficient electro-optical detecting system.

In an exemplary embodiment, the target-seeking system is a single radio frequency antenna consisting of two arrays of radio frequency selective annular slot patch excited radiator elements, one array for K-band energy, the other for X-band energy. The two arrays share a common ground plane with which both are coplanar. The annular slot patch excited radiator is innovational and a key segment to this invention. It's coplanar position to the ground plane surface effectuates a miniscule of diffraction and performance degradation to the concomitant radio frequency band while maintaining a highly efficient integral part of it's own detection system. Each array consists of at least four elements, with one or more elements per quadrant when two axis monopulse operation is desired. The ground plane has a space reserved in its center in which an electro-optically transmissive radio frequency reflective window may be inserted for integration of an electro-optical detector. The antenna is backed by two stripline circuit boards, each board comprising a comparator and a feed network for combining signals received by the annular slot patches in a desired fashion to provide directional information to the guidance computer.

The radio frequency antenna has a single multi-band image plate consisting of resonant dichroic surfaces which will selectively reflect X- and K-band energy. The multi-band image plate is fabricated with a low dielectric material. Conductive patterns such as monopole or multipole elements are on both sides of the multi-band image plate. The length, width and spacing of the conductive patterns are designed to form separate X- and K-band frequency selective surfaces that are partially transmissive/partially reflective for the radio frequencies of interest. This determines the degree of directivity for each array of the antenna. One surface passes X-band frequencies and reflects approximately 94% of the incident K-band RF energy. The other surface passes K-band frequencies and reflects approximately 94% of the incident X-band RF energy. These surfaces are placed effectively one-half wavelength of their respective incident RF energy above the ground plane. A space is left in the center of the multi-band image plate which corresponds to the space at the center of the ground plane to accommodate an electro-optical (EO) detector system.

The foregoing description of the exemplary embodiment of the invention is merely one configuration and is not intended to limit the scope of the invention. No attempt will be made to illustrate all possible embodiments, but rather only in general description list several assemblies employing a diversity of sub-units that are known to the inventors to realize coincident electrical behavior.

In an alternate embodiment, a multiple radio frequency target seeker may be fabricated by combining a dual band image array antenna using the above configuration in combination with a standard waveguide planar array which operates at a third radio frequency. The top surface of the waveguide planar array acts as the ground plane for the dual frequency image array. The annular slot patch excited radiator elements are placed coplanar with the top surface of the waveguide planar array. The dual-band image plate with frequency selective patterns and spacings corresponding to the desired radio frequencies for the image array is located above the reflective ground plane of the planar array.

Where there is a plurality of arrays, the primary band could consist of a high frequency planar array of shunt or series/series radiating slots in waveguide. The slotted surface of this array would serve as a common ground plane for the lower frequency dual band image antenna which includes two arrays of radio frequency selective patch/slot elements that are fully recessed, coaxially fed and coplanar to the slotted surface. The image plate surface nearest the common ground plane surface is one-half wavelength of the center frequency from the common ground plane surface and is partially reflective to the center frequency. The image plate surface farthest from the common ground plane surface is one-half wavelength of the lowest frequency from the common ground plane surface and is partially reflective to the lowest frequency. Both surfaces of the image plate appear to be transparent to the slotted waveguide planar array which is the highest frequency.

If a fourth frequency band (which is lower than the other 3 frequencies mentioned above) is desired, four coax-fed radiating elements (one per quadrant) may be located coplanar and linearly polarized with the image plate surface farthest from the common ground plane. This farthest surface of the image plate must be a total reflector for the lowest of the four frequencies in addition to being appropriately a partially reflective and transparent surface for the other three frequencies. From this same surface, at one-half wavelength of the lowest frequency is placed another image plate that is partially reflective to the lowest frequency and transparent to the three higher frequencies.

From the above 4 frequency antenna, by substituting the slotted waveguide planar array with a conductive surface to maintain the common ground plane, a different configuration 3 frequency antenna is illustrated.

The annular slot patch excited image array antenna may also be a single frequency configuration.

The formation of a plurality of arrays utilizing the annular slot patch excited radiating element is not intended to limit the assembly to a single configuration of radiators. It is conceivable that in the operation of multiple bands of arrays that the waveguide slot, the micro stripline slot, a flat spiral, dipoles or conventional patch components could be employed as energy emitting elements that make up a proper functioning antenna.

The annular slot patch excited radiating element may be used for antennas other than an image array.

An image plate need not be constructed by use of a low dielectric core with conductive surfaces on either side. It may be constructed from a plurality of parts such as two thin sheets of low dielectric material with each having a conductive surface and a spacer (solid slab or ring) to provide proper positioning of the conductive surfaces. One or both conductive surfaces may be constructed from wire which would eliminate the need for a thin sheet of low dielectric material.

Antenna operation is not limited to X- and K-band frequencies.

BRIEF DESCRIPTION OF THE DRAWINGS

Understanding of the present invention will be facilitated by consideration of the following detailed description of a preferred embodiment of; the present invention, taken in conjunction with the accompanying drawings. in which.

DETAILED DESCRIPTION OF THE PREFERRED EMBODIMENT

Figure 1:
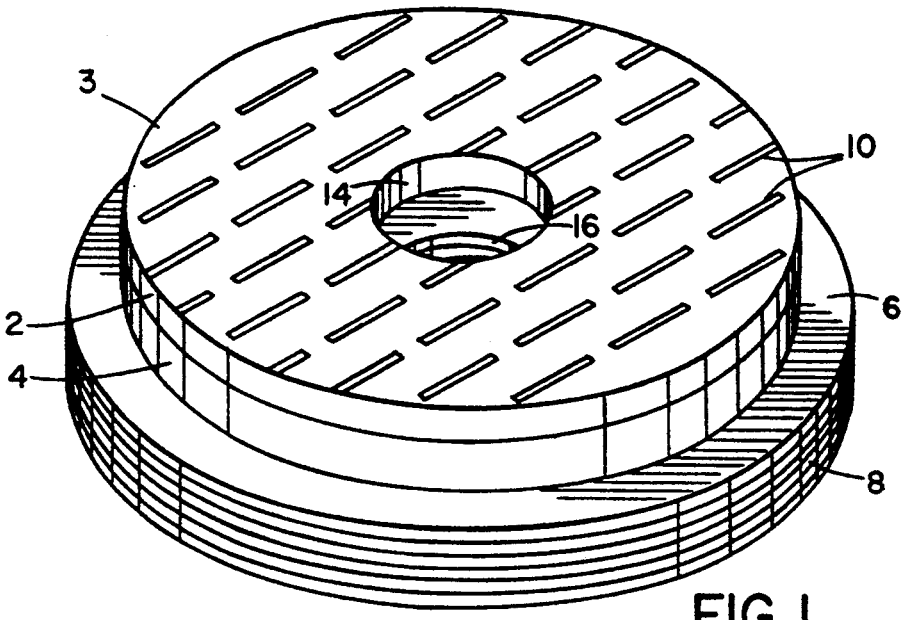
FIG. 1 is a perspective view of an antenna according to the present invention.
Figure 2:
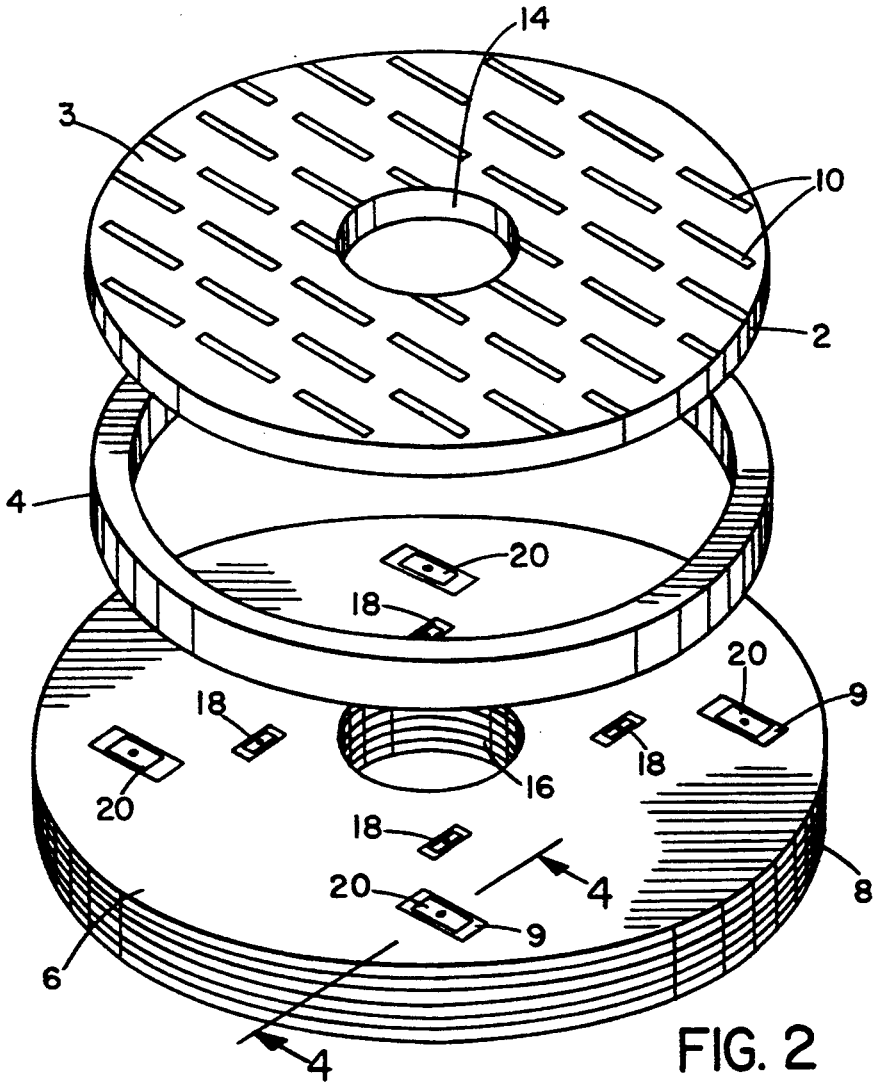
FIG. 2 is a forward looking aft exploded view of an antenna according to the present invention with openings to accommodate an electro-optical sensor.

Referring to FIGS. 1 and 2, image plate 2 has a pattern of partially reflective monopole elements 10 on its top surface 3. Image plate 2 is held at the desired position above ground plane 6 by dielectric spacer 4. Two arrays of patch radiating elements are located in ground plane 6. In the exemplary embodiment, four X-band annular slot patch excited radiating elements 20 and four K-band annular slot patch excited radiating elements 18 are arranged with one element per quadrant. Two stripline corporate feed/comparator network systems are included within circuitry 8, one network per array of elements. The use of the minimum number of radiating elements (one per quadrant) contributes to antenna gain by reducing the extent of the corporate feed network system.

In FIG. 2, area 16 in the ground plane is reserved for placement of an electro-optically transmissive/radio frequency reflective window and area 14 in the image plate is a hole for passage of electro-optical energy to permit integration of an electro-optical detector system, e.g., infrared, behind the antenna so as not to degrade the aperture size of the ground plane and to minimize aperture degradation of the image plate. Where no electro-optical system is to be used, the reflective patterns are continuous across the surfaces of the image plate 2 and the ground plane 6 is continuous.

Figure 3:
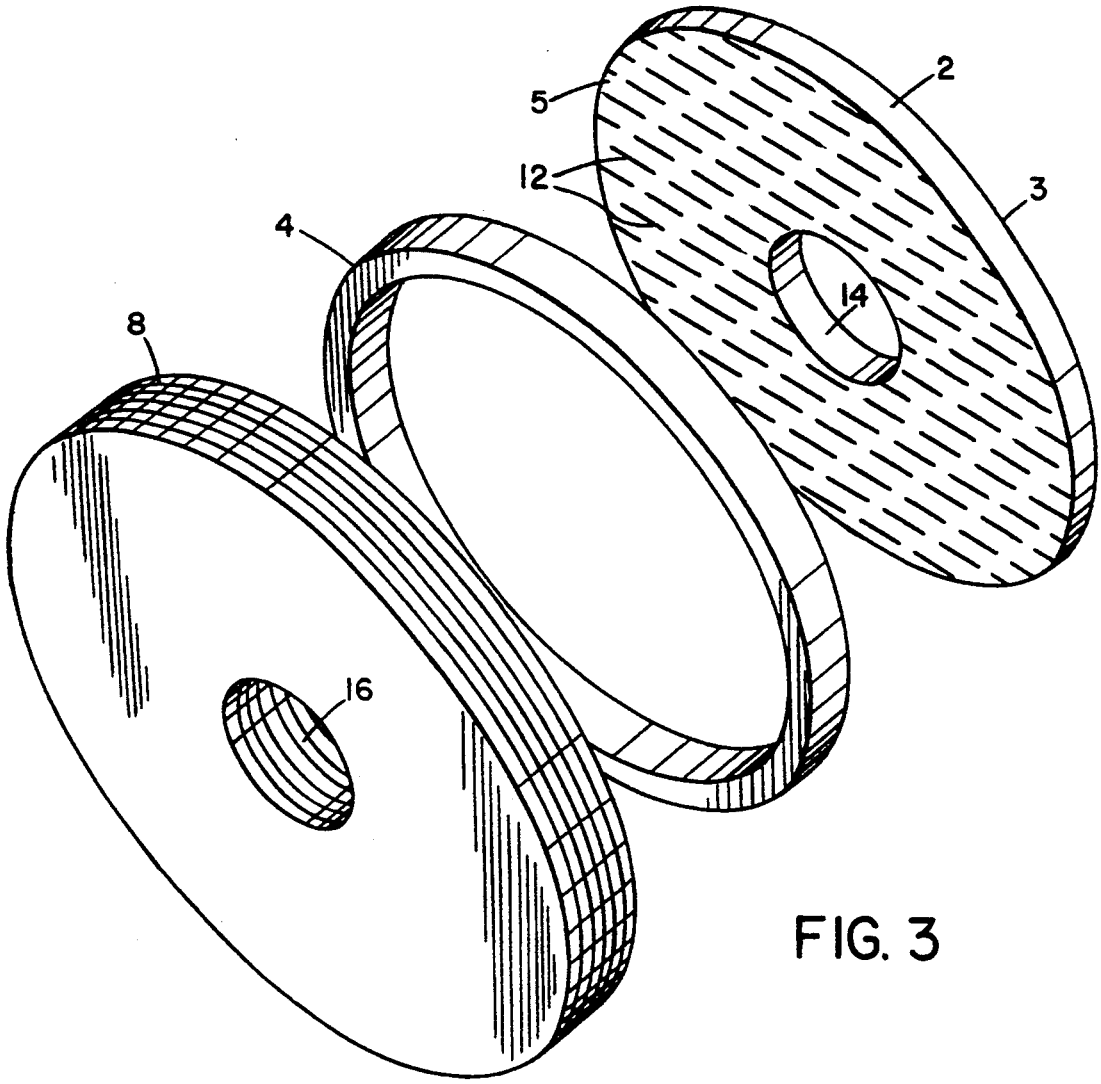
FIG. 3 is an exploded aft looking forward view.

FIG. 3 shows the bottom 5 of image plate 2 with a different pattern of reflective monopole elements 12, where both the size and spacing of elements 12 are different from elements 10 and are determined by the requirements for resonance of the desired wavelength.

It should be noted that the resonant surface is not necessarily limited to monopole elements, but may be any other configuration with resonant properties.

Image plate 2 is constructed of a low dielectric foam such as Rohacell with a dielectric constant of 1.07. The foam is bonded to thin sheets of copper using an adhesive, preferably epoxy due to its chemical resistance, the adhesive layer being uniformly distributed over the entire surface of the foam. The copper sheets are patterned using photoresist and exposure to an appropriate light source projected through a mask. The field of the copper is etched away using a chemical such as ferric chloride which will not penetrate the adhesive layer, leaving pattern copper, here shown as monopole elements, on both sides of the image plate 2.

The thickness of the foam core of which the image plate 2 is made depends upon the chosen wavelengths to be radiated and received. The reflective pattern on the bottom 5 will be positioned to be one-half wavelength above the ground plane 6 for the shorter of the two selected wavelengths. The top 3 must be positioned effectively one-half wavelength above the ground plane for the longer of the two selected wavelengths. Considerations must be included, however, for the dielectric constants of the foam and the layers of adhesive of the top 3 and bottom 5 in determining the thickness of the foam core needed to achieve an effective one-half wavelength above the ground plane for the top reflector pattern.

Figure 4:
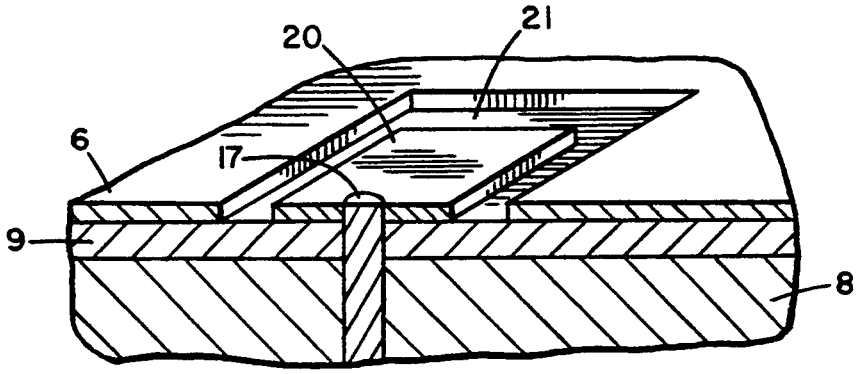
FIG. 4 is a perspective cross-sectional view taken on line 5—5 of FIG. 2.

The preferred form of the radiating element is that of a micro-strip annular slot patch excited radiator, shown in FIG. 4. An annular slot 21 is formed in the ground plane 6 about the conducting patch 20 by use of photolithographic techniques and etching to remove a small portion of the conductive film surrounding the patch from the dielectric sheet 9 to which the conductor is affixed. This annular slot 21 isolates the patch from the ground plane 6 to create an antenna element of the correct length and width to permit resonance at ;the frequency corresponding to the desired wavelength. A coaxial feed point 17 runs through the dielectric 9 to provide contact between the conducting patch and the feed network.

Figure 5:
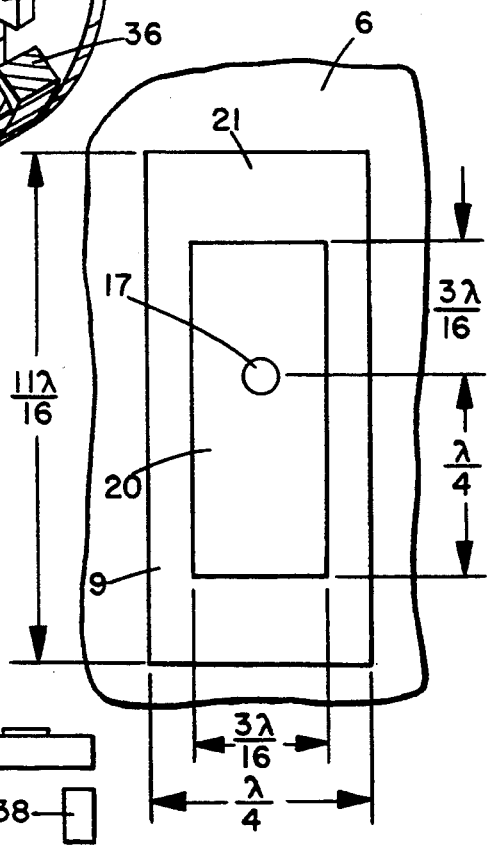
FIG. 5 is a view showing the approximate dimensions of the annular slot patch excited radiating element.

FIG. 5 is a view of the annular slot patch excited radiating element showing the approximate dimensions of the annular slot (which exposes the dielectric substrate), the conductive patch 20 and the position of the coaxial feed point 17. The radiating element is empirically optimized from these dimensions.

The preferred form of the feed network is a stripline corporate feed/comparator network, with one such network for each array of annular slot patch excited radiating elements and one or more stripline boards for each array. With four elements per array, the comparator feed network combines the elements into two sub-arrays and then determines the sum and difference of each sub-array. The two sub-array values are then combined to determine sum, difference in azimuth and difference in elevation. These values are communicated to the controlling mechanism of the missile to indicate azimuth and elevation adjustments.

Figure 7:
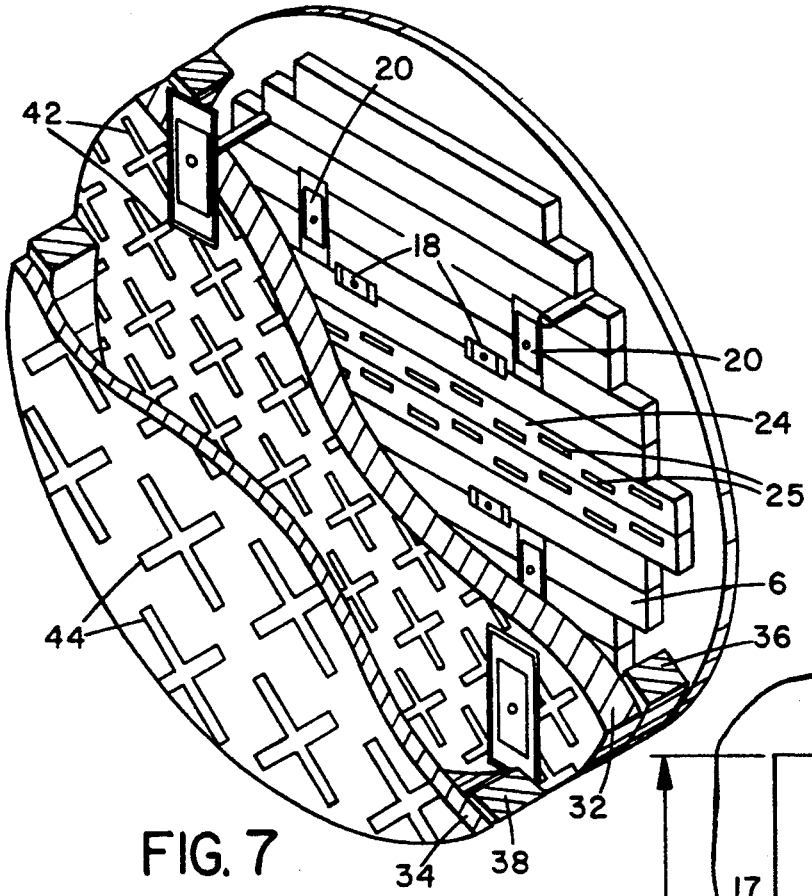
FIG. 7 shows an alternate embodiment of combined image plate and slotted array technologies.
Figure 6:
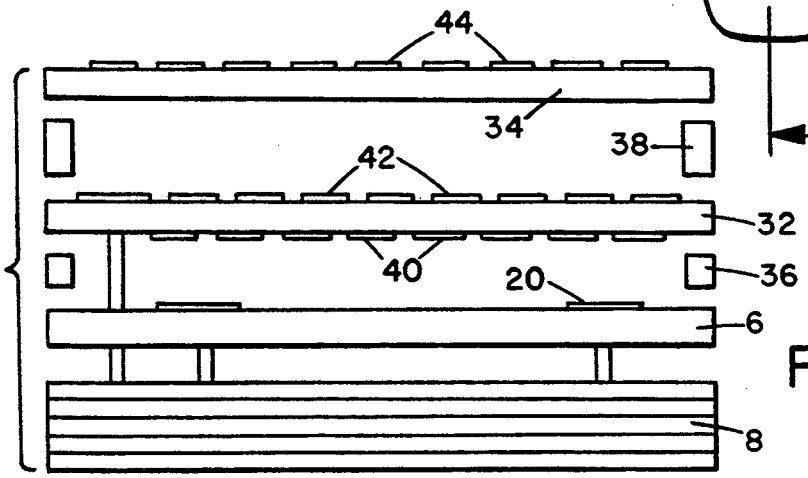
FIG. 6 is an exploded cross-sectional view of an alternate embodiment of combined image plate and slotted array technologies.

In an alternate embodiment, shown in FIGS. 6 and 7, the antenna may combine image plate technology with a standard waveguide slotted array 24. This configuration consists of a stripline corporate feed/comparator network 8, a slotted waveguide planar array 24, two image plates 32 and 34, two spacer rings 36 and 38 and three arrays of radiating elements 40, 42 and 44 which work in conjunction with the image plates 32 and 34.

The waveguide planar array consists of slots 25 which are formed in the ground plane with precision machining techniques. The energy received through the slots is conveyed through radiating waveguide circuitry and coupled through feedguide and input slots to a stripline feed/comparator network on printed circuit board beneath the assembly. This feed/comparator network may be a corporate feed/comparator network 8 as above, or may be any other suitable network for radiating, receiving and comparing the desired RF signal in order to provide useable input to the controller. The waveguide array operates at the shortest wavelength so that the two image plates appear transparent to the waveguide array. It also operates at the shortest wavelength so that the resonant slots 25 are configured to allow the waveguide surface to appear to be a continuous ground plane to the second and third shortest wavelengths.

The dual frequency image plate 32 operates at the second and third shortest wavelengths. It is located at a distance effectively one-half of the second shortest wavelength from the ground plane 6 by a spacer ring. The image plate 32 is of a thickness so as to position the cross-dipole pattern 42 at one-half of the third shortest wavelength from the waveguide ground plane 6. The cross-dipole pattern 44 of the single frequency image plate 34 is located from the the cross-dipole pattern 40 of the dual frequency image plate 32 at a distance effectively one-half of the longest wavelength by a combination of spacer ring 38 height and single frequency image plate 34 thickness. The single frequency image plate 34 thickness is related only to structural stability.

The target seeking antenna system of this invention permits the sharing of the same aperture by different wavelengths of radio frequency energy by positioning the sets of radiators/receivers coplanar with the ground plane. Aperture blockage is therefore eliminated. The present invention also permits incorporation of an electro-optical radiation detector with little or no degradation or interference between the radio frequency and electro-optical detector parts to provide a system with small physical size and low cost. In addition, the antenna has improved gain due to the use of the minimum number of radiation elements, reducing the extent of the corporate feed network system.

It will be evident that there are additional embodiments which are not illustrated above but which are clearly within the scope and spirit of the present invention. The above description and drawings are therefore intended to be exemplary only and the scope of the invention is to be limited solely by the appended claims.

We claim:

1. Antenna for transmitting or receiving a plurality of wavelengths of electromagnetic radiation comprising:

a ground plane;

a plurality of arrays of radiating/receiving elements disposed in said ground plane, each array of said plurality being adapted to radiate/receive a selected wavelength of electromagnetic radiation;

a dielectric spacer abutting said ground plane; and an image plate abutting said dielectric spacer comprising a first dielectric core having a first thickness and a first patterned reflective surface on a bottom of said first dielectric core, and a second patterned reflective surface on a top of said first dielectric core, said bottom positioned by said dielectric spacer at a distance of one-half of a first selected wavelength of electromagnetic radiation above said ground plane, said first thickness adapted so that said top is one-half of a second wavelength of electromagnetic radiation above said ground plane, wherein each of said first patterned reflective surface and said second patterned reflective surface comprises a plurality of conductive elements having a length, a width and a spacing corresponding to said first selected wavelength and said second selected wavelength, respectively.

2. An antenna as in claim 1 further comprising a second dielectric core disposed on top of said first dielectric core and having a third patterned reflective surface corresponding to a third selected wavelength, said third patterned reflective surface being disposed above said ground plane at a distance corresponding to one-half of said third selected wavelength.

3. An antenna as in claim 1 wherein said array of radiating/receiving elements are coplanar with said ground plane.

4. An antenna as in claim 1 wherein said image plate has an opening at its center.

5. An antenna for transmitting and receiving a plurality of wavelengths of electromagnetic radiation comprising;

a ground plane;

a plurality of arrays of radiating/receiving elements disposed in said ground plane, each array of said plurality being adapted to radiate/receive a selected wavelength of electromagnetic radiation; and a first dielectric core disposed on over said ground plane, said first dielectric core having a first bottom, a first top and a first thickness, a first patterned reflective surface on said first bottom and a second patterned reflective surface on said first top, said first patterned reflective surface being positioned one-half of a first selected wavelength above said ground plane, said first thickness being adapted so that said second patterned reflective surface is one-half of a second selected wavelength above said ground plane, wherein each of said first patterned reflective surface and said second patterned reflective surface comprises a plurality of conductive elements having a length, a width and a spacing corresponding to said first selected wavelength and said second selected wavelength, respectively.

6. A method for making an antenna for transmitting or receiving a plurality of wavelengths of electromagnetic radiation which comprises:

forming a plurality of arrays for radiating/receiving elements in a ground plane;

selecting a first dielectric core with a thickness equal to the difference between one-half of a first selected wavelength and one-half of a second selected wavelength;

forming a first patterned reflective surface on a bottom of said first dielectric core, wherein said first patterned reflective surface comprises a plurality of conductive elements having a length, a width and a spacing corresponding to said first selected wavelength;

forming a second patterned reflective surface on a top of said dielectric core, wherein said second patterned reflective surface comprises a plurality of conductive elements having a length, a width and a spacing corresponding to said second selected wavelength; and attaching said first dielectric core with said bottom one-half of said first selected wavelength above said ground plane.

7. A method for making an antenna as in claim 6 further comprising the steps of:

selecting a second dielectric core;

forming a third patterned reflective surface on a top of said second dielectric core, wherein said third patterned reflective surface comprises a plurality of conductive elements having a length, a width and a spacing corresponding to a third selected wavelength; and attaching said third dielectric core so that said third patterned reflective surface is positioned one-half of said third selected wavelength above said ground plane.

* * * * *